United States Patent [19]

Rimmer et al.

[11] Patent Number: 4,712,358

[45] Date of Patent: Dec. 15, 1987

[54] PRODUCTION OF TEA AND THE LIKE BAGS

[75] Inventors: James R. Rimmer, Wirral; Ronald M. Sweeney, West Kirkby, both of England

[73] Assignee: Premier Brands U.K. Limited, Birmingham, England.

[21] Appl. No.: 849,480

[22] Filed: Apr. 8, 1986

[51] Int. Cl.[4] ..... B65B 9/02; B65B 29/02

[52] U.S. Cl. ..... 53/450; 53/113; 53/548; 414/31

[58] Field of Search ..... 53/428, 113, 111 R, 53/548, 550, 450, 546, 147; 414/31

[56] References Cited

U.S. PATENT DOCUMENTS

| | | | |
|---|---|---|---|
| 2,139,039 | 12/1938 | Salfisberg | 53/548 X |
| 2,697,541 | 12/1954 | Patterson et al. | 414/31 X |
| 3,456,423 | 7/1969 | Helms | 414/31 X |
| 3,498,019 | 3/1970 | Rait | 53/548 X |
| 4,035,984 | 7/1977 | Gerlach et al. | 53/202 X |
| 4,262,473 | 4/1981 | Brooke | 53/548 X |
| 4,609,556 | 9/1986 | Goedert | 53/202 X |

*Primary Examiner*—James F. Coan

*Attorney, Agent, or Firm*—Popper, Bobis & Jackson

[57] ABSTRACT

The invention provides a machine for manufacturing and handling tea bags, wherein the tea bags are produced by laminating together two webs with individual quantities for tea therebetween. Two rows of tea bags, formed in the webs, and the tea in the bags is biased upwardly of the webs. This is followed by severing of the webs into two individual single tea bag row webs, and this is followed by transverse severing of the web to produce individual tea bags. The tea bags are held into magazines so as to form two stacks therein and stacks of tea bags are moved laterally of the magazine into the inserting device and the inserting device places the two stacks of tea bags into a carton. The two stacks of tea bags are placed together prior to insertion of the carton and extra conversion is given to the stacks to compensate for revising the tea.

19 Claims, 6 Drawing Figures

PRODUCTION OF TEA AND THE LIKE BAGS

This invention relates to the production of tea and the like bags. Although reference will be made hereinafter only to the production of tea bags, it is to be mentioned that the actual material i.e. tea or an alternative such as coffee, herbs or flavouring, is not in essence in the present invention, and it is intended that all materials of a nature which flavours or conditions the liquid as it passes through the material of the bag, which is in the nature of a filter, should be covered.

As is well known, a tea bag comprises essentially a small sachet of filter material, such as paper or netting containing a quantity of tea in finely comminuted form so that when the bag is placed in boiling water, the water will be flavoured by the tea, but the tea particles cannot pass through the filter material of the bag.

The production of tea bags is well developed, and it is possible using known machinery to produce tea bags at high speed, for example over 1,000 tea bags per minute, and machines producing 2 to 4,000 tea bags per minute are not uncommon. There is a disadvantage with that kind of tea bag production however in that it is not possible to produce what are known as "singles" at high speed. "Singles", as the name suggests, are single individual tea bags which can be removed from a carton of bags individually without other tea bags in the carton being extracted at the same time.

When the tea bags are produced by the known machinery at high speed, they are produced by trapping the quanities of tea between filter material webs, and they are produced in side by side rows, typically two rows, extending longitudinally of the webs. The webs are subsequently split transversely to define groups of tea bags of which the individual tea bags lie side by side. If the webs were split longitudinally to provide individual tea bags, problems arise in connection with the handling of the individual tea bags which have to be collated by the machinery into stacks, and the stacks placed directly into the cartons. These problems do not exist when the individual tea bags of the groups are allowed to remain connected via the web material. However, in order to facilitate separation of the individual bags by the consumer when removing same from the carton, a cutting device of the machine provides perforations between the respective tea bags in a group so that separtion of the individual bags in a group is quite simple.

However, simple though the said separation may be, experience has shown that the biggest single complaint received from consumers in relation to tea bag useage is that the tea bags are not "singles" and that when a user wishes to use a single bag, for example to place it directly into a cup for making of a single cup of tea, invariably the group of bags is extracted from the carton. Therefore, consumer complaint as related to the fact that tea bags are not in singles in cartons is, somewhat surprisingly, considerable.

The present invention seeks to provide a machine for making tea bags by which single tea bags can be produced and placed in cartons at high speed.

Although the invention was made as a result of work done on known equipment, it involves a number of novel concepts which can be embodied in existing equipment by modifying same, or can be embodied in original equipment.

To explain the novel aspects of the invention, it is useful to explain in more detail how a tea bag making machine operates. The following explanation will be given in relation to a tea bag making machine which produces tea bags in groups of two, but it is to be mentioned that the invention is not to be considered as limited to such production.

A first web of the filter material travels horizontally, and a mechanism deposits quantities of tea on this web in two side by side rows, the individual tea quantities being spaced transversely and longitudinally on the travelling web. A second web is brought into overlying contact with the first web, and the two webs are sealed in peripheral regions trapping the tea in individual bags to provide a sachet web, the seals extending transversely and longitudinally thereof. The thus formed sachet web of tea bags, still travelling horizontally, passes a perforating device which puts a line of perforations down the centre of the sachet web, but not disconnecting the bags transversely. A transverse cutter severs the individual groups (of two each) of bags, and feeds them into a magazine in turn, and subsequent groups are placed on top of preceding groups so that the groups become stacked in the magazine. A collating device separates a predetermined number of groups of tea bags in the stacks and moves it to the bottom of the magazine. The group is pushed laterally from the lower end of the magazine into an insertion device, and the insertion device places the stack of groups into a carton located under the inserting device. The carton is either moved away from the inserting device after receiving the stack or indexed if it is to receive a further group of tea bags in the same carton. When the carton is full it is moved away from the inserting device and finally it is closed at a downstream station of the machine.

The machine works at high speed because the two tea bags in each group remain connected, albeit across a perforated connection line, but if one simply severs the horizontally travelling web of tea bags in an effort to produce "singles" then the loss of connection of the tea bags in the group creates unexpected and considerable problems to such an extent that the machine simply will not perform effectively, and the tea bags either fall from the machine or take up the wrong dispostion, or burst.

The present invetion provides a number of modifications for the above process which results in improved operation to such an extent that the machine can run whilst producing singles and placing same in the cartons which travel through the machine. In a first modification, means is provided to ensure that during the travel of the tea bags to the magazine, the tea inside the bags has its position changed in order to bias the tea position in relation to the tea bag cavity, and preferably to the outsides of the travelling sachet web, whereby the location of the centre of gravity of the mass of tea in the bag can be more accurately determined. By doing this, one achieves a more dependable knowledge of the position of the centre of gravity of the tea in each bag, and a more positive control of the handling of the individual bags can therefore result. In particular, if the tea is biassed to the outsides of the sachet web, then in the magazine, supporting ledges at the top thereof for receiving the individual bags can be dimensioned to ensure that the bags are supported in such a manner to remain as much as possible in horizontal planes, because one of the problems of handling single tea bags is to maintain the tea bags in substantially horizontal planes in the magazine. This is normally achieved by maintaining the connection between individual bags in a group, but when the tea bags have been separated into individual bags, then there is less control of the tea bag handling. Also, by biassing the tea in this fashion there is less tendency for the individual bags when moving from the transverse cutter into the magazine to cascade i.e. have a rotational component of movement, into the magazine and they move more in a purely linear component of movement, because the said ledges support the main mass of the tea bags immediately the bags leave the lateral cutter.

In a second modification, a platform on which the stack of bags fit is modified so as to provide a greater surface area, and this platform co-operates with a lead out member located at the bottom of the magazine. When the platform moves to the lowermost position, and the group of bags is pushed laterally from the magazine, the bags slide over the platform and the lead out member. The lead out member preferably has a chamfered edge which co-operates with corresponding chamfered edge on the underside of the platform so that together they form a smoothly continuous surface which enhances the ejection of the stack of bags, now in single form, out of the magazine. This utilisation of a lead out member and modified platform enhances stack ejection and there is no catching of the individual bags on any projection or the like on the surface defined by the lead out member and platform.

In order to ensure that there will be an additional compressive push of the stack in a horizontal direction, the pusher member which ejects the stack of singles from the magazine into the insertion member has a pusher surface which is located further forward then the pusher surface used in the conventional machine. This is to ensure that the stack of bags experiences a horizontal compression in a direction moving the bags of the respective groups closer together. This arises because when the web of travelling bags is cut to define singles as explained herein, then the overall width of the bag pairs is greater as compared to when the bag pairs in a group are left connected across the line of perforations.

In relation to the insertion step, the equipment is modified to ensure that the stacks of tea bags when inserted into the carton is given a vertical compression, because the redistribution of the tea to bias same as described herein has a tendency to give the tea bag an overall greater thickness than it would have were the tea evenly distributed throughout the bag. This compresison may be achieved by raising the height of the platform or base on which the cartons stand whilst the stacks are being inserted in the cartons.

For the cutting of the travelling web into singles, there may be used a disc cutter in place of the perforating cutter in the conventional machine, or alternatively a power driven circular disc may be provided which is driven at a higher speed than the speed of travel of the web, and runs in a slot underneath the web so as to ensure positive cutting action.

In yet a further aspect the invention provides a machine for producing tea or the like bags, wherein the bags are formed in moving webs of material wherein a first web has individual and spaced portions of tea or the like placed thereon, the second web is applied over the first web, and the webs are sealed around said portions of tea forming a web of tea bags, the webs are severed transversely to separate the tea bags from each other, and the tea bags are placed in a magazine on top of each other, and wherein the machine produces webs of tea bags arranged in two rows extending longitudinally of the webs, including severing means for severing webs longitudinally to produce two separate single rows of tea bags, wherein the longitudinal severing means comprises a disc cutter which runs in a slot underneath the web so as to ensure complete severing of the web.

Embodiments of the invention will now be described, by way of example, with reference to the accompanying drawings, wherein.

Figure 1:
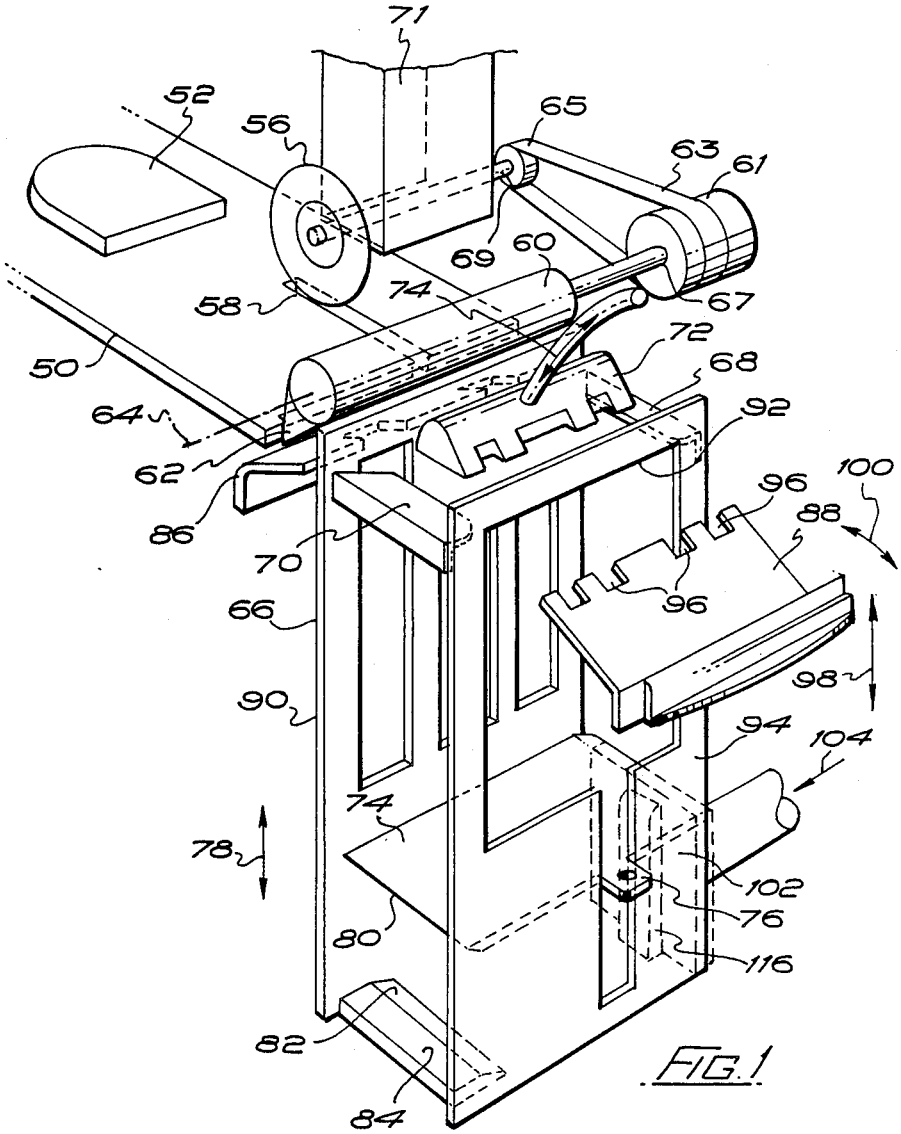
FIG. 1 is a perspective view illustrating several of the essential components of a tea bag making machine.
Figure 2:
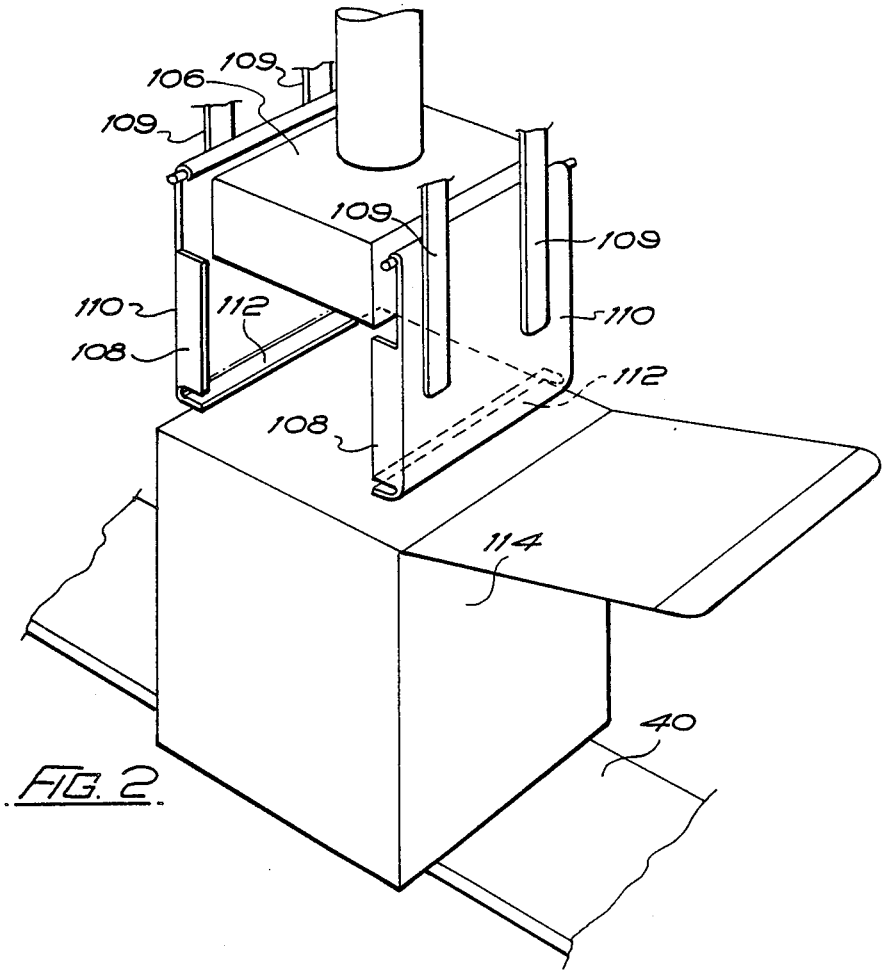
FIG. 2 is a perspective view illustrating another part of the machine.
Figure 3:
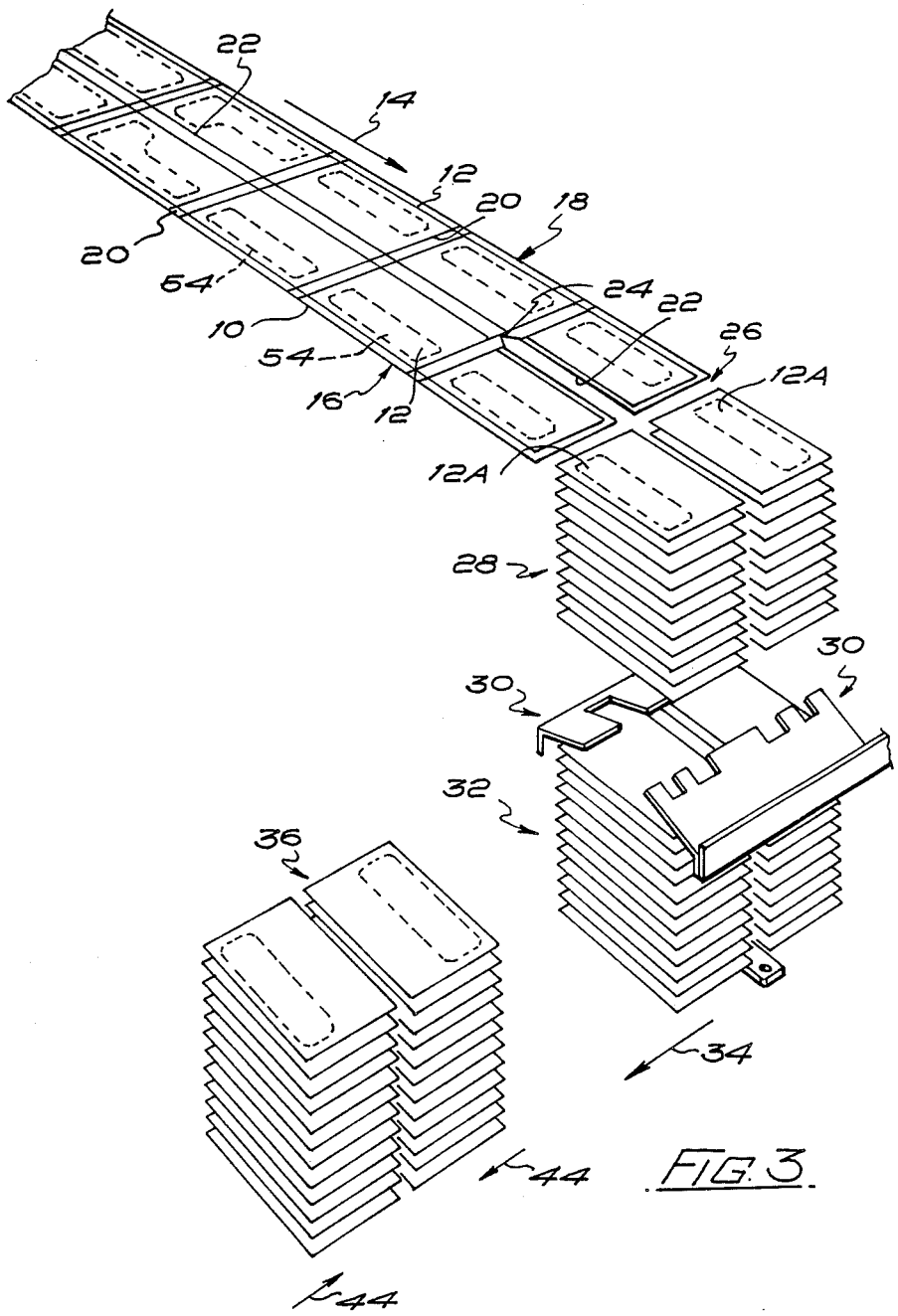
FIG. 3 is a diagram illustrating how the tea bags travel through the machine.

Referring to the drawings, FIGS. 1 and 2 illustrate machine components and are in perspective elevation to show how the machine components operate, whilst FIG. 3 shows the path of movement of the tea bags through the machine stations illustrated in FIGS. 1 and 2. One should therefore appreciate that FIG. 3 should be considered as superimposed on FIGS. 1 and 2 for full illustration of the operation, but the separated method of illustration has been selected for ease of understanding. The machine as shown in FIGS. 1 and 2 has been modified in accordance with various aspects of the present invention.

Figure 4:
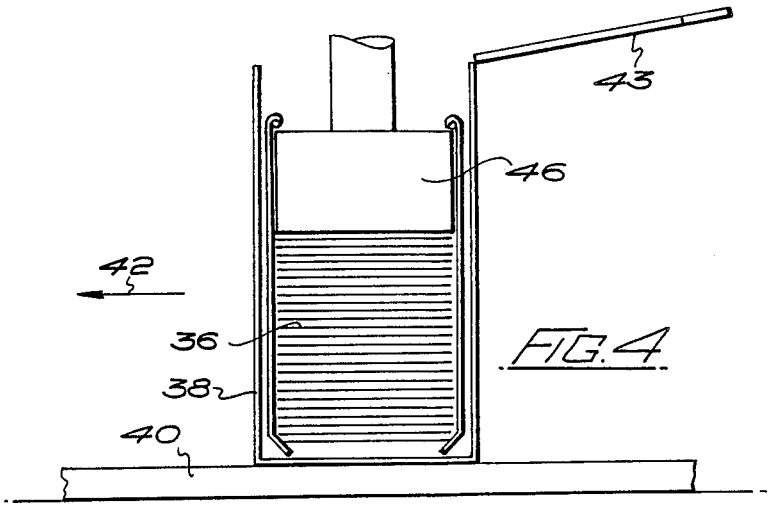
FIG. 4 is a sectional side elevation illustrating how the tea bags are inserted in packaging cartons.

Referring firstly to FIG. 3, a web 10 of tea bags 12 is shown travelling horizontally as indicated by arrow 14. The web defines two rosw 16 and 18 of tea bags and transverse seals 20 split the web into groups of tea bags, each group comprising two tea bags 12. There is a longitudinal seal 22 which defines the individual tea bags 12 in each group. At location 24 the web 10 is severed along the seal 22, and at location 26, the individual tea bags of each group are severed from the remainder of the web to define individual tea bags 12A, arranged in pairs. The pairs of individual tea bags are stacked in the magazine as shown at 28, and collating members indicated by numerals 30 serve to group a predetermined number of groups of tea bags in a stack as shown at 32. This stack is displaced by a pusher in the manner indicated by reference 34 horizontally and laterally of the magazine to the position shown by numeral 36, and in which position the stack is engaged by an inserting mechanism, and the inserting mechanism positions the stack in a carton 38 as shown in FIG. 4. The carton 38 stands on a base plate 40 and when it has been filled with the tea bags 36, the carton 38 is moved horizontally as indicated by arrow 42 to a station whereat the top 43 of the carton is closed.

In moving the stack of tea bags from the position 32 to the position 36 as indicated by arrow 34, the individual tea bags are pushed together as indicated by arrows 44 to compensate for the spread of the bags when the web is cut as indicated by numeral 24.

Furthermore, the base plate 40 as shown in FIG. 4 is raised compared to the conventional machine to ensure that the insertion plunger 46 compresses the stack of tea bags 36 by more than would normally be effected, this being required as the stack of tea bags has a greater height than it would normally have if the tea were not positioned biassed in the bags in a manner as will be explained hereinafter.

Referring now to FIG. 1, the machine has horizontal decking 50 along which the web 10 travels, and the decking 50 is provided with a displacement block 52 which is shaped and serves to displace the tea in the bags to the outsides of the web 10, as shown at 54 in FIG. 3.

A cutting disc 56 forms the cut in the web 10 at the location 24, and there is a slot 58 in an anvil (to be described) in which the cutting disc 56 locates. The cutting wheel is driven at a greater speed than the speed of travel of the web 10 over the decking 50. A cutting cylinder 60 with a radial cutting blade 62 and which is rotatable about the axis 64 serves to separate the pairs of tea bags as indicated by 12A in FIG. 3. The disc 56 is driven by a belt and pulley connection 61, 63, 65 from the shaft 67 of the cutting cylinder 60, the disc drive shaft 69 being supported by the support block 71. The magazine 66 is provided with internal ledge plates 68 and 70 which receive the pairs of tea bags delivered by the cutting roller 60, the ledges 68 and 70 being of increased size compared to the conventional machine so as to receive and support the pair of bags in a substantially horizontal plane. It is to be remembered that the tea in the bags is biassed to the sides of the web 10, and therefore the ledges 68 and 70 will effectively support such bags in a desirable disposition. A pusher bar 72 oscillates as indicated by the arrow 74 about an arcuate path, and pushes the topmost pair of tea bags in a downwards direciton in the magazine 66. Inside the magazine 66 is a support platform 74 which has a lug 76 connected to a lift mechanism in order to effect raising and lowering of the platform 74 as indicated by the arrow 78. The platform 74 is made larger than the platform as used in the conventional equipment, and at one edge, the front edge, the platform is provided with an underside chamfer 80 which is adapted to co-operate with a rear chamfer 82 on the top side of a lead out plate 84 located in the base of the magazine.

The collator plates identified previously by numeral 30 are indicated in FIG. 1 by numerals 86 and 88. Collator plate 86 comprises three spaced fingers which fit through spaced slots in the side wall 90 of the magazine, whilst collater plate 88 is a flat plate which fits through a single large aperture 92 in the side 94 of the magazine. The plate 88 has only small cut outs 96 so that it will not foul with the pusher bar 72.

The collator plates 86 and 88, in syncronism with the operation of the machine, move up and down the magazine as indicated by arrow 98, and into and out of the stack of tea bags in the magazine as indicated by the arrow 100.

Specifically, as the pairs of individual tea bags are loaded in the magazine 66 as described, with the platform 74 just below the bottom edge of aperture 92, so the stack of singles tea bags builds up in the magazine 66. The collating plates 86 and 88 are moved into the stack so as to separate a predetermined number of tea bags located between th e platform 74 and the collating plates 86, 88 from the remainder of the tea bags in themagazine. The collating plates and platform now move downwardly as indicated by arrow 98, until the platform chamfer 80 and lead out plate chamfer 82 overlap providing a smooth ejection surface. Next, a pusher 102 is displaced as indicated by arrow 104, thereby pushing the stack of tea bags out of the magazine 66 and into the holding device which is illustrated in FIG. 2. The holding device comprises a plunger head 106, pivotal holding or gripping plates 110 which have stop ledges 108. The bottoms of the plates 110 having supporting ledges 112, but the bottom of the insertion device is otherwise open. Metal fingers 109 resiliently restrain the plates from pivoting apart until the appropriate instant in the cycle of operations as will be explained herein. When the tea bags are inserted in the insertion device, the plates 110 are pivoted inwardly slightly in order to provide a secure grip of the stack of tea bags and then the whole assembly is lowered into the carton 114 to be filled with the tea bags. At the end of the downward stroke, the base of the carton 114, located on the base plate 40 is located so that the distance between the plate 40 and the undersurface of plunger block 106 is less than the height of the stack of tea bags whereby the bags are vertically compressed to ensure that they will fit into the carton 114. This is achieved as explained previously by providing a raised portion to the base plate 40. The plates 110 are then retracted whilst the block remains in a down position, the plates 110 pivoting apart during this movement as the ledges 112 pass the tea bags, against the resilience of the springs 109 until they are clear of the stack. Subsequently, the block 106 is retracted to the position shown in FIG. 2 to complete the insertion.

Also, the pusher 102 is provided with a thickness increasing portion 116 so that when the pusher is advanced to move the bags into the insertion device, the stop bar 108 will act to push the two piles of individual tea bags in the stack closer together.

Figure 5:
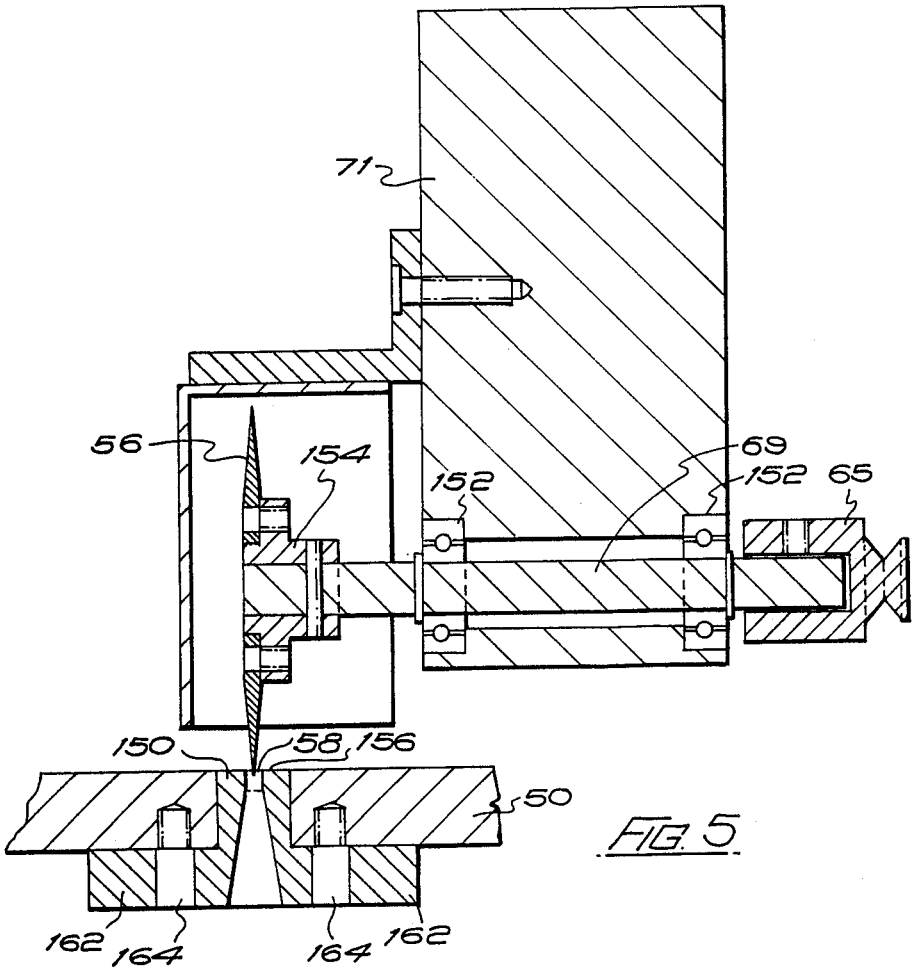
FIG. 5 is a sectional side elevation of the cutter disc and anvil.

Referring now to FIG. 5, a novel form of cutter arrangement has been designed for the machine according to this invention, and in the drawing, the support block 71 is shown, although the means for mounting this block on the machine is not shown. Such means comprises a bracket into which the block fits telescopically, and a locking screw enables the block 71 to be locked in any of an infinite number of vertically adjusted positions, for the purposes of maintaining the correct cooperation between the cutting disc 56 and an anvil 150 with which the cutting disc cooperates. The shaft 69 carrying the pulley 65 is mounted for rotation in block 71 by roller bearings 152, and the disc 56 is mounted via a mounting bush 154. The disc 56 in this example is of the narrow profile shown comprising a centre section of approximately 30 mm diameter and of an even thickness of 2.5 mm, the cutting portion of the disc being a diameter of 60 mm, and the cutting portion tapering from 25 mm at the centre portion to 0 at the cutting edge. This disc is therefore a slender and extensive component. The anvil 150 with which the disc cooperates is provided with the slot 58 with which the cutting edge of the disc locates as shown in FIG. 5. The slot 58 is of a dimension of the order of 2 mm wide at the top, but a a slight distance under the top surface 156 of the anvil, the slot tapers outwardly in a downwards direction to a width of 6.4 mm. The shaping of the slot in this fashion is to ensure that the tiny particles of the cut paper web which drop into the slot 58 can fall away from the region of the slot and through the bottom of the anvil for appropriate collection. The cutting disc cutting edge lies centrally of the slot 58 at the top side 156 o the anvil so that in fact the cutting edge does not bear against any chopping surface, as is in the case in the conventional machine. The disc is driven at high speed so as to slice through the paper cleanly and to generate minimum cutting fragments. As the disc wears, it can on the one hand be removed and sharpened, and on the other hand if the sharpening process reduces the external diameter of the disc, the disc will still be effectively useable as its height position can be lowered by lowering of the bracket 71. Best results have been found by positioning the disc so that its cutting edge barely penetrates the slot 58 i.e. so that the edge of the cutting disc is almost tangential to the surface 156 of the anvil, but it is possible that the cutting disc edge can penetrate below the surface 156 if required.

Figure 6:
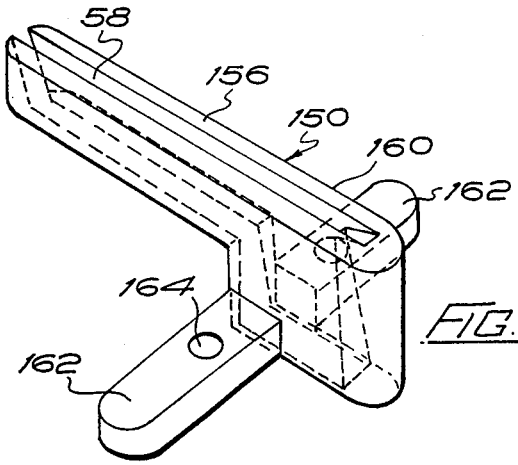
FIG. 6 is a perspective view of the anvil shown in FIG. 5.

Referring to FIG. 6 in conjunction with FIG. 5, the anvil will be seen to comprise a main elongated body portion 160 having the slot 58 therein, and also defining the said upper surface 156 of the anvil. On the sides, towards the bottom edge of the body 160 there are fixing lugs 162 provided with apertures 164 for fixing screws or the like. The anvil is inserted in an appropriate cut out in the decking 50 so that the upper surface 156 lies flush with the decking as shown in FIG. 5, and the lugs 162 lie to the underside. Screws inserted through the holes 164 and engaging in apprpriate apertures in the decking 50 enable the anvil to be removably secured to the decking. The anvil as well as the disc can be removed and replaced if required.

All of the moving components will of course be syncronised to operate in sequence and at the correct instant in the cycle operations.

The various modifications and improvements contribute individually and in combination to enable the high speed handling of singles tea bags.

We claim:

1. A machine for producing tea bags, comprising:

means for moving first and second webs of material through the machine, means for placing individual portions of tea on the first web as it moves through the machine so that said tea portions are spaced transversely of the web length, means for applying the second web over the first web and over said portions of tea, means for sealing said first and second webs together around said tea portions to form two parallel rows of connected tea bags, means for severing the webs transversely so as to provide side by side but separated pairs of tea bags, a magazine for receiving said pairs of tea bags on top of each other to define therein two separated sideby side tea bag stacks, and means for displacing the tea in the bags to the sides of the bags remote from a longitudinal center line of the webs during travel of the webs through the machine and prior to insertion of the bags in the magazine.

2. A machine according to claim 1, wherein said means for displacing comprises a member located centrally of the webs, and over which the webs pass.

3. A machine according to claim 2, wherein said means for severing webs longitudinally comprises means located downstream of the means for displacing so that said longitudinal severing takes place after said displacing.

4. A machine according to claim 3 wherein the longitudinal severing means comprises a disc cutter which runs in a slot underneath the web so as to ensure complete severing of the web.

5. A machine according to claim 1, wherein the stacks of tea bags are displaceable from the magazine laterally of the height direction of the stacks into an insertion mechanism for placing the stacks into the tea bag carton, and wherein there is a means for pushing the stacks together to decrease the overall width thereof prior to insertion of same into the carton.

6. A machine according to claim 4, wherein the disc cutter is power driven via a belt and pulley drive arrangement, from a drive shaft of the means for severing the webs transversely.

7. A machine according to claim 6, wherein the magazine has supporting ledges at the top thereof for receiving the individual bags, the said ledges being dimensioned to ensure that the bags with the biased tea therein are supported in such a manner to remain as much as possible in horizontal planes.

8. A machine according to claim 1, wherein tea bags are moved downwardly in the magazine while resting on a platform from an elevated position to a lowermost position and from which lowermost position each stack of tea bags is ejected laterally, wherein the platform in the lowermost position cooperates with a lead out member located at the bottom of the magazine ensuring the effective displacement of each stack of tea bags laterally of the magazine.

9. A machine according to claim 8, wherein the lead out member has a chamfered edge which cooperates with a corresponding chamfered edge on the underside of the platform so that in the lowermost position, the lead out member and platform cooperate to form smoothly continuous surface.

10. A method of producing tea bags, comprising the steps of:

moving first and second tea bags of material through a machine, placing individual portions of tea on the first web as it moves through the machine so that said portions are spaced transversely of the web length, applying the second web over the first web and over the portions of tea, sealing the first and second webs together around the tea portions to form two parallel rows of connected tea bags, severing the webs longitudinally and transversely between the pairs of tea bags, inserting the pairs of tea bags in a magazine on top of each other so as to define in the magazine two side by side but separated tea bag stacks, and displacing the tea in the tea bags to the sides of the bags remote from a longitudinal center line of the webs during movement of the webs and prior to the insertion of the bags in the magazine.

11. A machine for producing tea or the like bags, wherein the bags are formed in moving webs of material wherein a first web has individual and spaced portions of tea or the like placed thereon, the second web is applied over the first web, and the webs are sealed around said portions of tea forming a web of tea bags. the webs are severed transversely to separate the tea bags from each other, and the tea bags are placed in a magazine on top of each other, and wherein the machine produces webs of tea bags arranged in two rows extending longitudinally of the webs, including severing means for severing webs longitudinally to produce two separate single rows of tea bags, wherein the longitudinal severing means comprises a disc cutter which runs in a slot underneath the web so as to ensure complete severing of the web.

12. A method according to claim 1, wherein the lead out member has a chamfered edge which cooperates with a corresponding chamfered edge on the underside of the platform so that in the lower position, the lead out member and platform cooperate to form a smoothly continuous surface.

13. A method of producing tea or the like bags, wherein the bags are formed in moving webs of material wherein a first web has individual and spaced portions of tea or the like placed thereon, the second web is applied over the first web, and the webs are sealed around said portions of tea forming a web of tea bags, the webs are severed transversely to separate the tea bags from each other, and the tea bags are placed in a magazine on top of each other, and wherein means is provided to ensure that during the travel of the tea bags to the magazine, the tea inside the bags has its position changed in order to bias the tea position in relation to the tea bag cavity of each bag, whereby the locationof the centre of gravity of the mass of tea in the bag is shifted enabling the more effective handling of the bags.

14. A method according to claim 10, further including the step of displacing the tea by a member located centrally the webs, and over which the webs pass.

15. A method according to claim 14, wherein said step of severing occurs downsteam of the place wherein the tea is displaced.

16. A method according to claim 15, wherein the step of longitudinal severing is performed by a disc cutter which runs in a slot underneath the webs so as to ensure complete severing of the webs.

17. A method according to claim 16, further including the step of power driving the disc cutter driven via a belt and pulley drive arrangement, from a driven shaft of the machine.

18. A method according to claim 10 further comprising the steps of removing the stacks of tea bags from the magazine, inserting the removed stacks of tea bags into cartons in a direction which is the height direction of the stack, and compressing the stacks of tea bags in height to compensate for the tea in respective bags being displaced towards one side of each stack.

19. A method according to claim 10, wherein the magazine has supporting ledges at the top thereof for recieving the individual bags, the said ledges being dimensioned to ensure that the bags with the displaced tea therein are supported in such a manner to remain as much as possible in horizontal planes.

* * * * *